US006328469B1

(12) United States Patent
Banco

(10) Patent No.: US 6,328,469 B1
(45) Date of Patent: Dec. 11, 2001

(54) STORAGE BAG WITH POCKET FOR COAT HANGER ATTACHMENT

(75) Inventor: Michael J. Banco, Caledonia, WI (US)

(73) Assignee: S. C. Johnson Home Storage, Inc., Racine, WI (US)

( * ) Notice: Subject to any disclaimer, the term of this patent is extended or adjusted under 35 U.S.C. 154(b) by 0 days.

(21) Appl. No.: 09/454,069

(22) Filed: Dec. 2, 1999

(51) Int. Cl.[7] ..... B65D 33/01; B65D 33/14; B65D 33/16

(52) U.S. Cl. ..... 383/23; 206/287; 383/64; 383/87; 383/103

(58) Field of Search ..... 383/22, 23, 87, 383/63, 64, 103; 206/286, 287

(56) References Cited

U.S. PATENT DOCUMENTS

| | | | | |
|---|---|---|---|---|
| 2,129,857 | | 9/1938 | Metzger . | |
| 3,776,372 | | 12/1973 | Lemelson . | |
| 3,782,622 | | 1/1974 | Montgomery . | |
| 3,834,497 | | 9/1974 | Furst . | |
| 4,000,768 | * | 1/1977 | Siegel | 383/23 |
| 4,332,347 | | 6/1982 | Clayton . | |
| 4,580,667 | * | 4/1986 | Herwood | 383/23 X |
| 4,590,610 | | 5/1986 | Rhyne . | |
| 5,065,864 | | 11/1991 | Schmitt . | |
| 5,809,621 | | 9/1998 | McCree et al. . | |
| 5,836,056 | | 11/1998 | Porchia et al. . | |

* cited by examiner

*Primary Examiner*—Stephen P. Garbe

(57) ABSTRACT

Disclosed are plastic storage bags for storing clothing, linens and other items. The storage bag has sidewalls defining a cavity having a mouth opening at the top. A closure mechanism extends along the mouth for opening and closing the bag. A thin, side panel or flap is joined to one of the sidewalls along its top and sides to define an inverted pocket sized to contain a clothes hanger. The inverted pocket has a bottom opening for inserting the clothes hanger into the pocket and a top opening sized of lesser extent for receiving a hook of the clothes hanger without allowing the clothes hanger to pass through the top opening.

9 Claims, 5 Drawing Sheets

FIG. 5
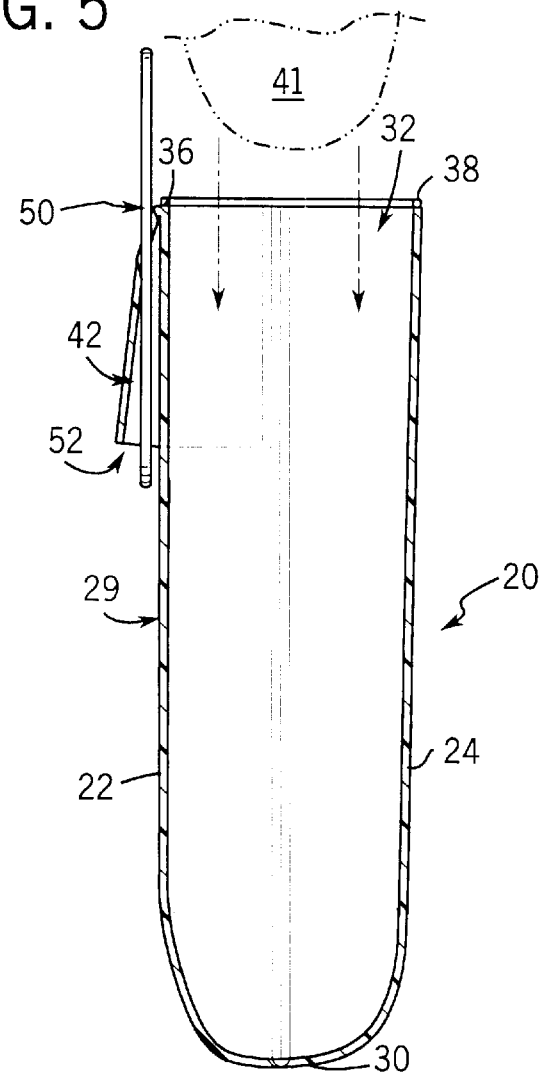
FIG. 6
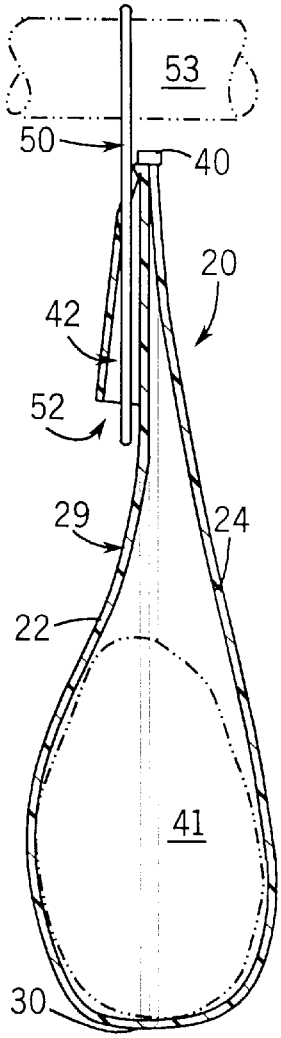
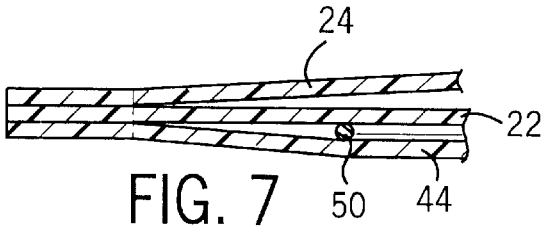
FIG. 7

FIG. 9
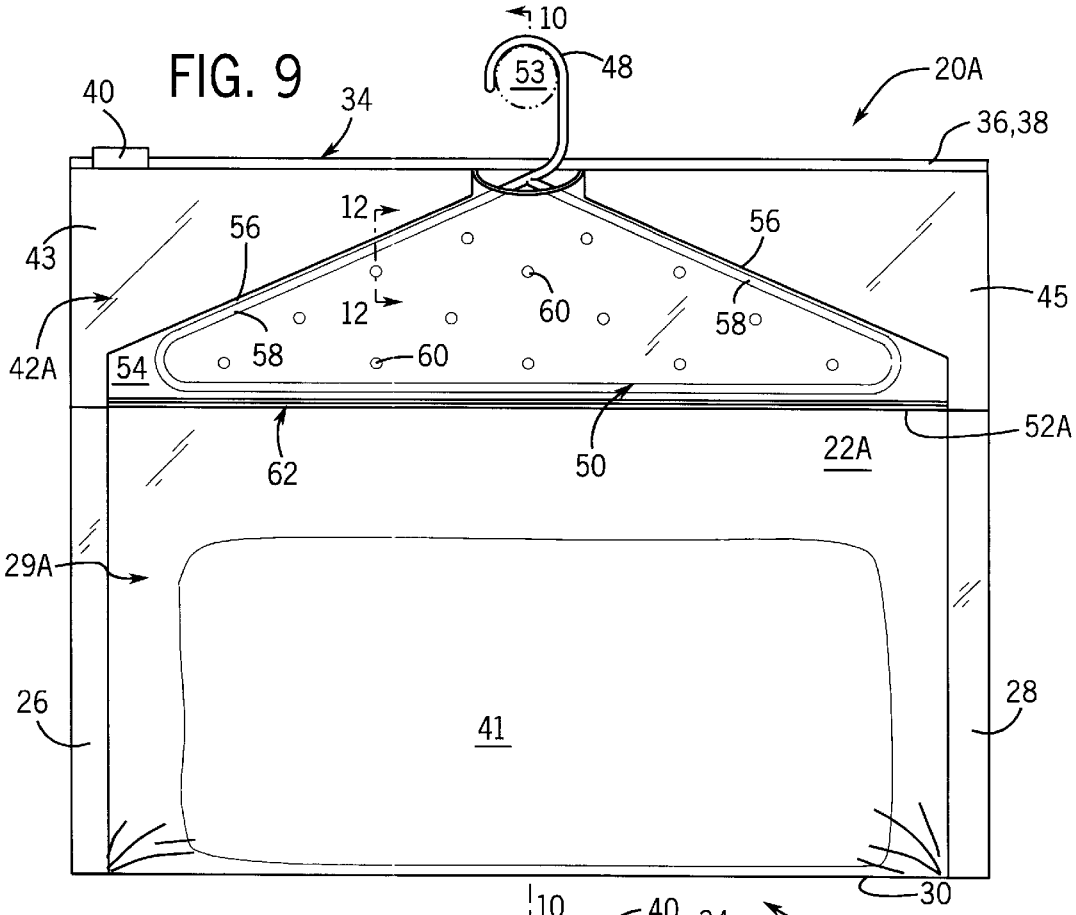
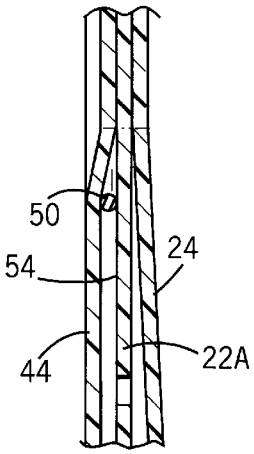
FIG. 12
FIG. 8
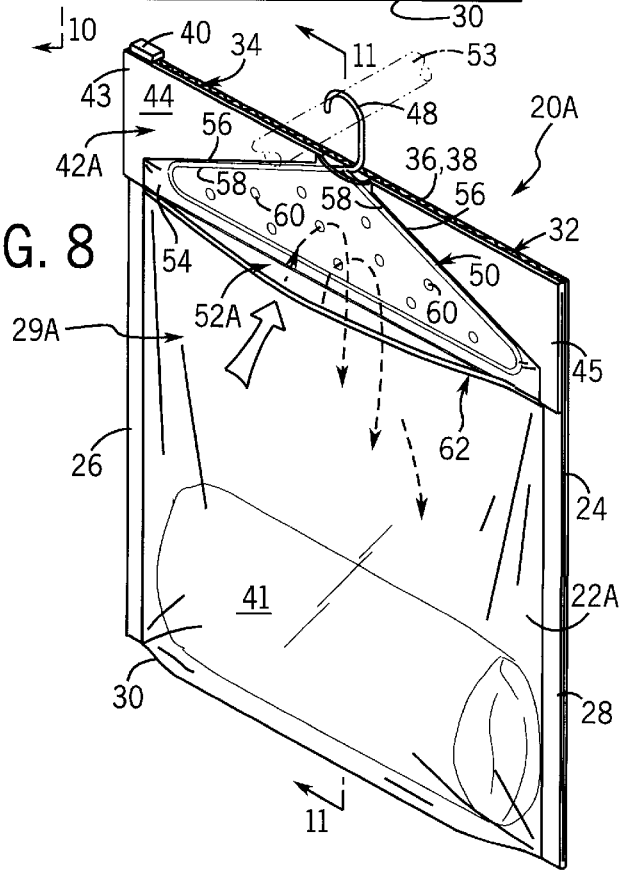

STORAGE BAG WITH POCKET FOR COAT HANGER ATTACHMENT

CROSS REFERENCES TO RELATED APPLICATIONS

Not applicable.

STATEMENT REGARDING FEDERALLY SPONSORED RESEARCH

Not applicable.

BACKGROUND OF THE INVENTION

The present invention relates to storage bags which are especially adapted for use with conventional clothes hangers.

The prior art has developed a variety of clothing or storage bags for use in protecting clothing, linens or the like from dust, insects, and other environmental factors during storage. See e.g. U.S. Pat. Nos. 2,129,857, 3,776,372, 3,782,622, 3,834,497, and 5,065,864. These patents disclose garment storage bags and containers that can be suspended from a suitable hook or closet rod by a hanger device attached at the top of the bag. The disclosure of these publications and of all other publications referred to herein are incorporated by reference as if fully set forth herein.

However, when clothes hangers are used to suspend the storage bags, they usually extend through a hole at or near the top of the bag, thereby exposing the clothing to some aspects of the environment during storage. Even when the clothing is hermetically sealed during storage, prior art designs have not provided convenient attachments to conventional type hangers. Some prevent the bags from being stored without a hanger when not being used. As a result, the bags take up more space when folded or otherwise stored away, and the hanger cannot be used in a conventional manner for other purposes.

Further, some of the better hangable prior art storage bags have an undesirably high cost of manufacture. Still others mount the hanger in a position that requires the bag entry to be inconveniently low, or unnecessarily elongate the design.

Accordingly, there is a need for improved hangable storage bags.

SUMMARY OF THE INVENTION

In one aspect, the invention provides a storage bag. It has a flexible envelope with a top and a bottom bounded by sidewalls. The sidewalls are preferably made of a thermoplastic film and define a cavity. The top has a mouth allowing access to the cavity, and there is a closure mechanism extendable along the mouth for opening and closing the envelope.

There is also a side flap having a top, a bottom and sides (also preferably made of a thermoplastic film). The flap is joined to an outside surface of one of the envelope sidewalls along the top and sides of the flap to define an inverted pocket sized to be able to receive a clothes hanger. The pocket has a bottom opening for permitting the insertion of the clothes hanger in the inverted pocket and a top opening of lesser extent for receiving a hook of the clothes hanger without allowing the clothes hanger to pass through the top of the inverted pocket. When the hanger has been inserted in the pocket, the bag can be suspended by the hanger with the envelope sealed off from outside air in one embodiment, or in another embodiment with the envelope contents controllably exposed to desired vapors.

In preferred forms the closure mechanism is a zipper, a hook and loop fastener, has at least one button fastener, or has opposing fastener strips with interlocking projections. In an especially preferred form, the closure mechanism can have a slider capable of applying an inward force to the opposing fastener strips when sliding in one direction, so as to thereby couple the interlocking projections, and applying an outward force to the fastener strips when sliding in an opposite direction, so as to thereby disengage the interlocking projections. In other forms of the invention a sidewall of the envelope includes perforations adjacent to the side flap so as to allow air to enter the cavity from a space between the side flap and the sidewall. Entry of air into this space can be controlled by a second closure mechanism extendable along the bottom opening of the inverted pocket. The second closure mechanism preferably has opposing fastener strips with interlocking projections and can form a hermetic seal.

The bag can be made in various ways. For example, the sidewalls can be made from separate panels having top, bottom and side edges, with the bottom and side edges being joined together, and where the side flap is a separately formed panel of lesser dimension joined to the outside surface of a sidewall at the top and side edges. Alternatively, the bag can be formed from a single continuous thermoplastic sheet that has been folded to form the sidewalls and side flap. The bag is typically combined with a clothes hanger disposed within the inverted pocket, but can be used without a hanger if desired.

The invention also provides a method of making such plastic storage bags involving joining two generally rectangular panels of thermoplastic film at their side and bottom edges to form an envelope having a mouth at its top. One affixes a closure mechanism along the mouth of the envelope for opening and closing the envelope, cuts a notch proximate the center of a top edge of a flap suitable to receive a hook of a clothes hanger, and attaches the flap to an outside surface of one of the panels with the notch adjacent to the mouth of the envelope so as to thereby form an inverted pocket having an open bottom.

The invention also provides another method of making such plastic storage bags. One folds a single plastic sheet along a first line to form first and second sidewalls sharing a bottom at the first line, the first sidewall being longer than the second sidewall to define a flap area. One joins the first and second sidewalls at opposing side edges to define an envelope having a mouth at the top, affixes a closure mechanism along the mouth of the envelope for opening and closing the envelope, cuts a hook opening in the flap area suitable for receiving a hook of a clothes hanger, and folds the flap along a second line at the mouth of the envelope so that the flap is positioned adjacent to the first sidewall. One joins a top and sides of the flap to the first sidewall to define an inverted pocket.

In still another form the invention provides methods of using such plastic storage bags. One opens the closure mechanism at the mouth of the storage bag, positions stored items in the storage bag through the mouth, and then fastens the closure mechanism at the mouth of the storage bag. One then inserts a clothes hanger through a hanger opening at a bottom of the inverted pocket so a hook of the clothes hanger extends through the top opening, and suspends the storage bag by the hook of the clothes hanger.

It should be appreciated from this disclosure that a conventional hanger can be inserted into the pocket so that the storage bag can be hung from a conventional closet hanging bar or many other types of conventional hooks (e.g.

those found in luggage). When desired the storage bag will be hermetically sealed to store a wide variety of natural and synthetic fabrics (e.g., clothing, bedding, draperies), as well as other storable items. On the other hand, if it is desired that air be permitted into and out of the bag for some time period, this can be achieved through one or more holes adjacent the inverted hanger pocket. Thereafter, the "breathing" system can be closed off.

These and still other advantages of the present invention will be apparent from the description of the preferred embodiments which follows. It should be appreciated that the following embodiments are merely the preferred embodiments. Thus, the claims should be looked to in order to judge the full scope of the invention.

BRIEF DESCRIPTION OF THE DRAWINGS

FIG. 5 is a cross-sectional view taken along line 5—5 of FIG. 2;

FIG. 6 is a cross-sectional view taken along line 6—6 of FIG. 3;

FIG. 7 is a cross-sectional view taken along line 7—7 of FIG. 3;

FIG. 8 is a front perspective view of another embodiment;

FIG. 9 is a front elevational view of the storage bag of FIG. 8 (similar to FIG. 3) with a middle portion cut out;

FIG. 12 is a cut-away cross-sectional view taken along line 12—12 of FIG. 9;

DETAILED DESCRIPTION OF THE PREFERRED EMBODIMENTS

Figures 1, 2:
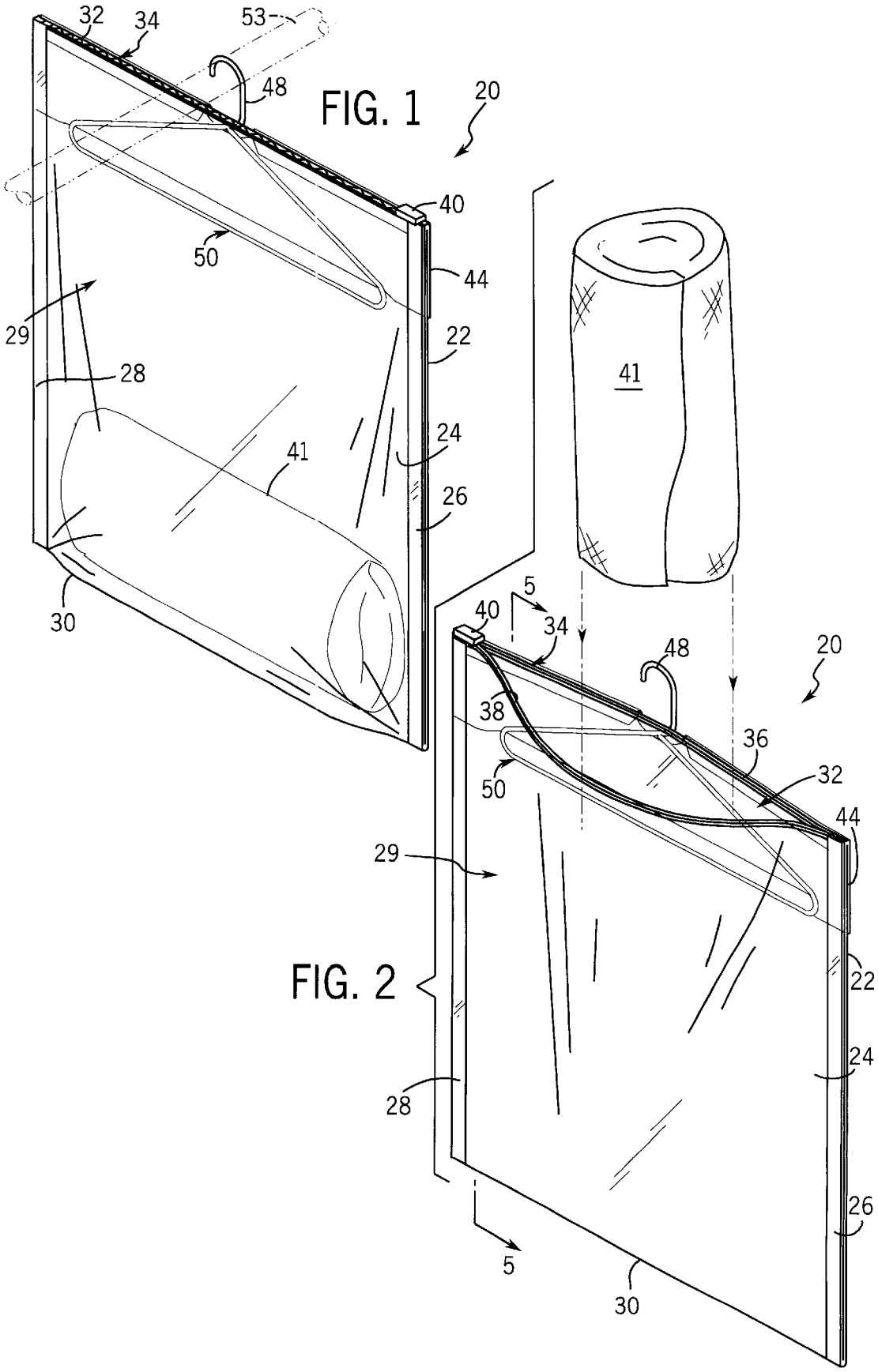
FIG. 1 is a rear perspective view of a first embodiment of a storage bag of the present invention, showing the storage bag containing a blanket and hanging from a closet rod.
FIG. 2 is a view similar to that of FIG. 1, but with the mouth of the bag opened and the blanket being outside the bag.
Figure 3:
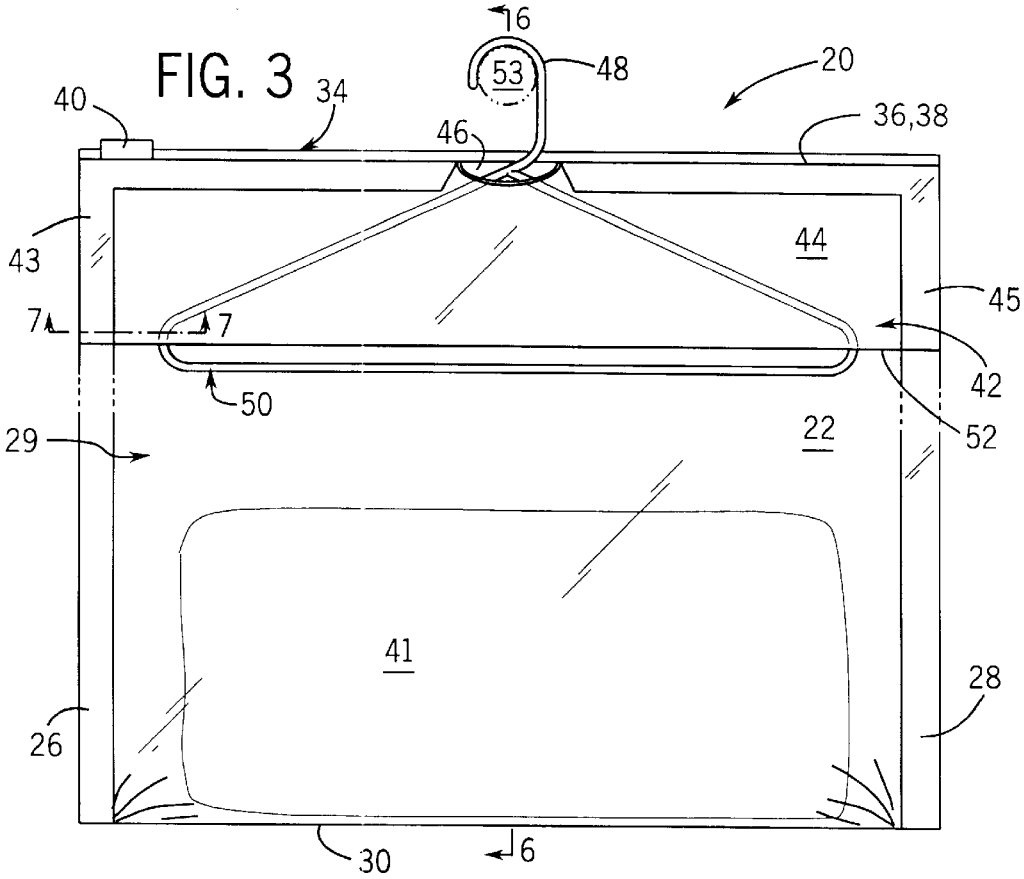
FIG. 3 is a front elevational view of the storage bag of FIG. 1, albeit shown without its middle portion.
Figure 4:
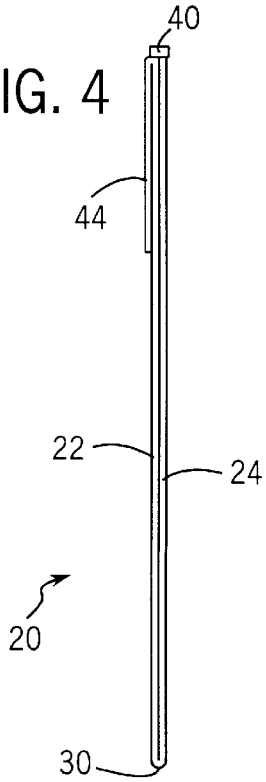
FIG. 4 is right side edge view of a closed, empty storage bag of FIG. 1, shown without a clothes hanger.
Figure 10:
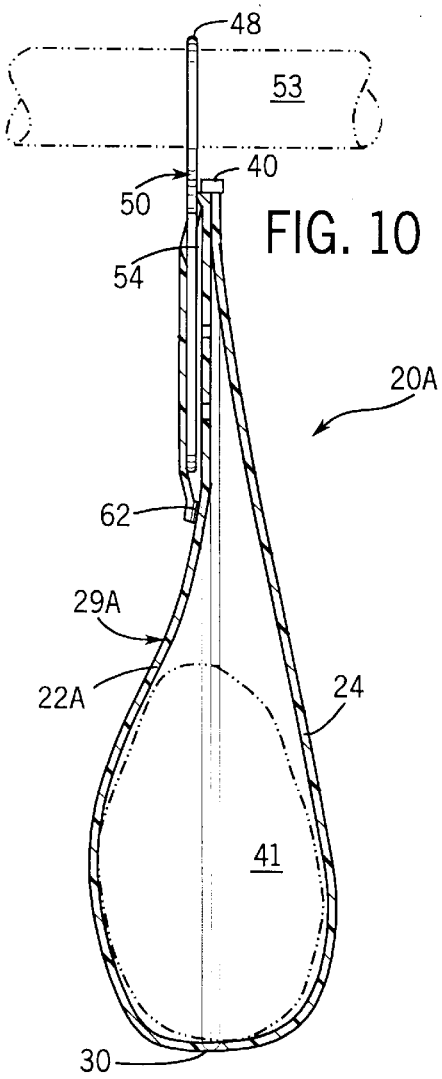
FIG. 10 is a cross-sectional view taken along line 10—10 of FIG. 9 (similar to FIG. 6)
Figure 11:
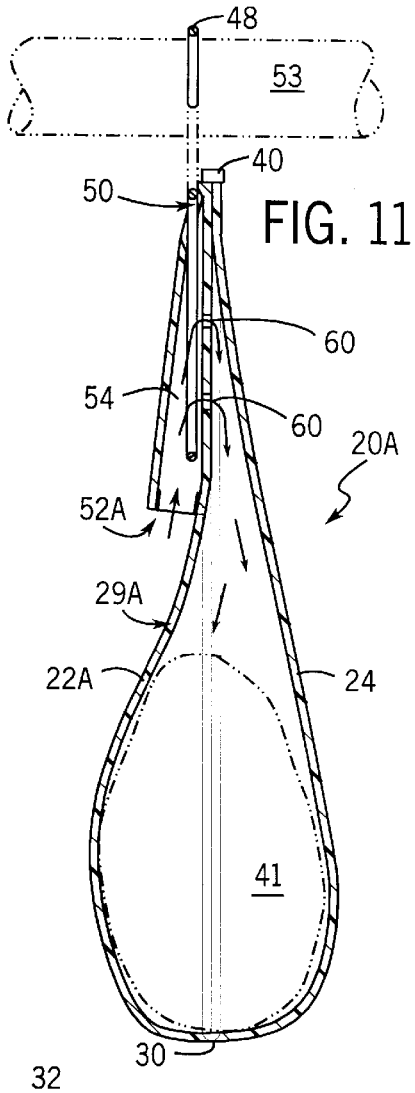
FIG. 11 is a cross-sectional view taken along line 11—11 of FIG. 8, similar to FIG. 10, albeit with the inverted pocket open at its bottom to allow air inside the storage bag through the perforations.

Referring first to the FIGS. 1–7 embodiment, a hangable storage bag 20 has a first sidewall 22 and an opposing second sidewall 24 joined together at two side edges 26, 28 and at a bottom 30 to form a flexible envelope 29. At the top of the sidewalls 22, 24 is a mouth opening 32 for accessing a cavity formed by the sidewalls 22, 24. Preferably the sidewalls 22, 24 are made of thermoplastic film, such as low density polyethylene, linear low density polyethylene, substantially linear copolymers of ethylene and a C3–C8 α-olefin, polypropylene, polyvinylidene chloride, mixtures of two or more of these polymers, or mixtures of one or more of these polymers with another thermoplastic polymer.

The mouth opening 32 is opened and closed by a closure mechanism 34. The closure mechanism 34 can be any of the variety of known resealable closure mechanisms typically used with plastic bags. The mechanism should be positioned at or adjacent near the top edge of each sidewall 22, 24. The closure mechanism 34 can be a button fastener, a hook and loop fastener or a conventional metal or plastic toothed zipper. Preferably, however, the closure mechanism 34 is a slider type reclosable fastener providing a hermetic seal of the mouth opening 32, such as those reclosable fasteners described in U.S. Pat. Nos. 5,809,621 and 5,836,056, the disclosures of which are incorporated by reference as though fully described herein. Food storage bags (without any hanger pocket) having such reclosable fasteners are commercially available under the brand name SLIDE-LOC® from S. C. Johnson & Son, Inc. of Racine, Wis.

To incorporate this closure mechanism into the present invention, the reclosable fastener has opposing first 36 and second 38 fastener strips, either extruded integrally with the sidewalls 22, 24 or extruded separately and affixed to the sidewalls 22, 24 along the mouth opening 32 at the top edges of the sidewalls 22, 24. The fastener strips 36, 38 each have upper and lower projections extending inwardly, which interlock when a plastic slider 40 unites them as it is moved along the edges in a closing direction. Conversely, the slider 40 disengages the projections of the fastener strips as it is slid in the opposite direction. Referring to FIGS. 5 & 6, in this way, the mouth opening 32 can be opened to insert one or more stored items 41 and then be closed to hermetically seal the items 41 (in the FIG. 1 embodiment).

At the top of the first sidewall 22 is an inverted pocket 42, preferably made of the same thermoplastic film as the sidewalls 22, 24. The pocket 42 is defined by a rectangular flap panel 44 having its side 43 and top 45 edges suitably affixed to the first sidewall 22. For example, the edges can be joined with an adhesive, pressure, heat, ultrasound or other suitable technique. Proximate the top of the panel 44 is an opening 46 through which a hook 48 of a conventional clothes hanger 50 can be inserted when the clothes hanger 50 is inserted through a bottom hanger opening 52 of the inverted pocket 42. The opening 46 in the panel 44 is sized to allow the hook 48, but not the hanger 50, to pass through so that the storage bag 20 may be suspended from a hanging rod 53 without slipping off the hanger 50.

Referring now to the alternative embodiment of FIGS. 8–12, similar parts are shown with similar numerals, albeit the designation "A" is used to indicate a different but analogous part. Storage bag 20A includes sidewalls 22A and 24 joined together at two side 26, 28 edges and at a bottom 30 to form a flexible envelope 29A. At the top of the sidewalls 22A, 24 is a mouth opening 32 for accessing a cavity formed by the sidewalls 22A, 24.

Further, the storage bag 20A has a closure mechanism 34 at a mouth opening 32 and a rectangular panel 44 forming an inverted pocket 42A at the top of the first sidewall 22A containing a clothes hanger 50. Also, as before, the inverted pocket 42A has a bottom hanger opening 52A for inserting the hanger 50 within the inverted pocket 42A and a top hook opening 46 through which the hanger hook 48 is inserted.

This embodiment differs from the first embodiment in that the panel 44 is joined to the first sidewall 22A along an increased area to define a generally triangular cavity 54 extending from the top opening 46 to the hanger opening 52A. Preferably, the cavity 54 is shaped so that angled edges 56 of the cavity 54 will abut angled members 58 of the clothes hanger 50 when the storage bag 20A is suspended by the hanger 50. In this way, the storage bag 20A is closely fit onto the clothes hanger 50.

Also in this embodiment, the portion of the first sidewall 22A forming the cavity has perforations 60 that under some conditions allow air to enter the cavity inside the storage bag 20A. A second closure mechanism 62 extends along the hanger opening 52A to close off the inverted pocket 42A and effectively seal the perforations 60 when desired.

The second closure mechanism 62 can be any suitable fastener such as those described above for opening and clothing the mouth. However, it preferably is a pressed reclosable type fastener operated by applied inward pressure on opposing fastener strips by hand so that the projections interlock without a slider mechanism.

Figure 13:
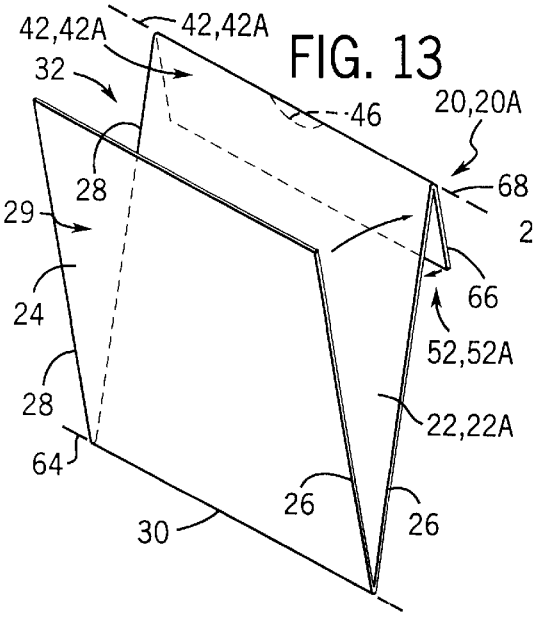
FIG. 13 is a perspective view of a single plastic sheet, the sheet being depicted during the process of being folded twice in a first method of making storage bags of the present invention.
Figure 14:
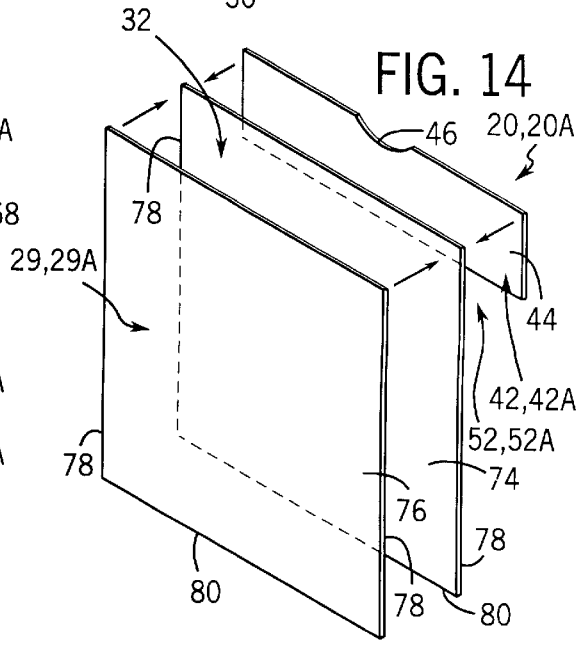
FIG. 14 is a perspective view of three separate plastic sheets, the sheets being depicted during an alternative process of making storage bags of the present invention.

Referring now to FIGS. 13 and 14, both embodiments of the storage bag 20, 20A can be made from one (FIG. 13) or multiple (FIG. 14) thermoplastic film sheets. Referring first to FIG. 13, it depicts a method of making the storage bag of the present invention where a single plastic sheet folded along a first fold line 64 to form the first 22, 22A and second 24 sidewalls which share a bottom 30 at the first fold line 64 and define a mouth opening 32 at the top. The first fold line 64 is located so that the first sidewall 22, 22A is longer than the second sidewall 24 so as to define a flap portion 66 unitary with the first sidewall 22, 22A forming the panel 44.

The first 22, 22A and second 24 sidewalls can then be suitably joined together at side edges 26, 28 to define an open mouthed envelope 29, 29A. A hook opening 46 can then be cut in the flap portion 66 proximate its top center for receiving the hook 48 of the clothes hanger 50. The flap portion 66 is then folded along a second fold line 68 located at the mouth opening 32 so that the flap portion 66 is folded back upon the first sidewall 22, 22A. The top 70 and sides 72 of the flap portion 66 are suitably joined to the first sidewall 22, 22A to define an inverted pocket 42, 42A for receiving the clothes hanger 50. The inverted pocket has a hanger opening 52, 52A at the bottom through which the clothes hanger 50 is inserted. A closure mechanism 34 is affixed along the mouth opening 32 at the top of the envelope 29, 29A for opening and closing the envelope 29, 29A.

Referring now to FIG. 14, in another preferred method of making the storage bag 20, 20A of the present invention, two rectangular panels 74, 76 having generally the same dimensions are suitably joined at side 78 and bottom 80 edges to form an envelope 29, 29A having a mouth opening 32 at its top. A closure mechanism 34 is affixed along the mouth opening 32 for opening and closing the envelope 29, 29A. A separate panel 44 is attached to another surface of one of the panels 74, 76 proximate the top of the envelope 29, 29A to form an inverted pocket 42, 42A having a hanger opening 52, 52A at the bottom for inserting a coat hanger 50 and a hook opening 46 at the top for receiving a hook 48 of the coat hanger 50.

Both methods described above can be employed to make the second described embodiment of the storage bag 20A.

However, the methods further include perforating a portion of the first sidewall 22A, joining the panel 44 (side flap portion 66) to the first sidewall 22A to form the triangular hanger cavity 54, and affixing a second closure mechanism 62 at the hanger opening 52A.

As mentioned, the storage bag 20, 20A of the present invention may be used for storing clothing, linens and any other suitably sized stored items. For example, heavy winter clothes and blankets can be stored in this way until the next winter. The storage bags are used by inserting a clothes hanger 50 into the inverted pocket 42, 42A through the hanger opening 52, 52A so that the hook 48 of the hanger 50 extends through the hook opening 46 of the inverted pocket 42, 42A. In the case of opening 52A having a second closure mechanism 62, it would have to be opened prior to inserting the clothes hanger 50. The inverted pocket can remain open at the hanger opening or be reclosed in the case of the FIG. 8 embodiment.

The closure mechanism 34 at the mouth opening 32 is opened and stored items can be inserted into the envelope while the bag is in the hanging position or before it is hung.

The inverted pocket of the FIG. 8 embodiment can also be used to retain moth balls, fragrancers, or other desired vaporizable material in a separate chamber from the envelope contents. Yet, the perforations will permit the envelope contents to be suitable treated during storage without directly contacting the material before it vaporizes.

The bag also functions as a standard storage bag when the hanger is not used. Thus, it provides flexibility for the consumer who may (during certain seasons) have limited closet rod space.

Other alternative embodiments also fall within the scope and breadth of the invention. For example, the storage bag may have an inverted pocket sealed to the first or second sidewall to define a triangular cavity sized to fit the clothes hanger, without having perforations in the first sidewall. Also, the sidewalls of the storage bag may contain a plurality of tiny perforations throughout, which allow the storage bag to breathe but reduce or prevent the infiltration into the storage bag of dust, dirt or other larger sized contaminants.

Thus, the claims should be looked to in order to understand the full scope of the invention.

INDUSTRIAL APPLICABILITY

Storage bags are disclosed which are particularly well suited for use in storing clothing, bedding and the like. Methods for efficiently forming these bags are also disclosed.

I claim:

1. A storage bag, comprising:

a flexible envelope having a top and a bottom bounded by sidewalls defining a cavity, the top having a mouth allowing access to the cavity;

a closure mechanism extendable along the mouth for opening and closing the envelope, the closure mechanism having opposing fastener strips with interlocking projections forming a hermetic seal; and a side flap having a top, a bottom and sides, the flap being joined to an outside surface of one of the envelope sidewalls along the top and sides of the flap to define an inverted pocket sized to be able to receive a clothes hanger, the pocket having a bottom opening for permitting the insertion of the clothes hanger into the inverted pocket and a top opening of lesser extent for receiving a hook of the clothes hanger without allowing the clothes hanger to pass through the top of the inverted pocket.

2. The storage bag of claim 1, wherein the closure mechanism further comprises a slider capable of applying an inward force to the opposing fastener strips when sliding in one direction, so as to thereby couple the interlocking projections, and applying an outward force to the fastener strips when sliding in an opposite direction, so as to thereby disengage the interlocking projections.

3. The storage bag of claim 1, wherein a sidewall of the envelope includes perforations adjacent to the side flap so as to allow air to enter the cavity from a space between the side flap and the sidewall.

4. The storage bag of claim 3, further comprising a second closure mechanism extendable along the bottom opening of the inverted pocket.

5. The storage bag of claim 4, wherein the second closure mechanism has opposing fastener strips with interlocking projections forming a hermetic seal.

6. The storage bag of claim 1, wherein the sidewalls are separate plastic panels having top, bottom and side edges, with the bottom and side edges being joined together, and wherein the side flap is a separately formed plastic panel of lesser dimension joined to the outside surface of a sidewall at the top and side edges.

7. The storage bag of claim 1, wherein the bag has been formed from a single continuous thermoplastic sheet that has been folded to form the sidewalls and side flap.

8. The storage bag of claim 1, further comprising a clothes hanger disposed within the inverted pocket.

9. A storage bag, comprising:

a flexible envelope having a top and a bottom bounded by sidewalls defining a cavity, the top having a mouth allowing access to the cavity;

a closure mechanism extendable along the mouth for opening and closing the envelope;

a side flap having a top, a bottom and sides, the flap being joined to an outside surface of one of the envelope sidewalls along the top and sides of the flap to define an inverted pocket sized to be able to receive a clothes hanger, the pocket having a bottom opening for permitting the insertion of the clothes hanger into the inverted pocket and a top opening of lesser extent for receiving a hook of the clothes hanger without allowing the clothes hanger to pass through the top of the inverted pocket, and a second closure mechanism extendable along the bottom opening of the inverted pocket, the second closure mechanism having opposing fastener strips with interlocking projections forming a hermetic seal, wherein a sidewall of the envelope includes perforations adjacent to the side flap so as to allow air to enter the cavity from a space between the side flap and the sidewall.

* * * * *